US007946257B2

(12) United States Patent
Hicks et al.

(10) Patent No.: US 7,946,257 B2
(45) Date of Patent: May 24, 2011

(54) WATER HEATER SEALED COMBUSTION CHAMBER ASSEMBLY

(75) Inventors: Kenneth J. Hicks, Saraland, AL (US); Mario Ramos Negrete, Montgomery, AL (US); Trevor Allen Damron, Marbury, AL (US); Hector Jose Donastorg, Waverly, AL (US)

(73) Assignee: Rheem Manufacturing Company, Atlanta, GA (US)

( * ) Notice: Subject to any disclaimer, the term of this patent is extended or adjusted under 35 U.S.C. 154(b) by 596 days.

(21) Appl. No.: 12/102,122

(22) Filed: Apr. 14, 2008

(65) Prior Publication Data

US 2009/0255487 A1 Oct. 15, 2009

(51) Int. Cl.
*F23C 5/02* (2006.01)

(52) U.S. Cl. ..... 122/17.1; 126/350.1

(58) Field of Classification Search ..... 122/13.01, 122/13.3, 17.1; 126/350.1, 361.1
See application file for complete search history.

(56) References Cited

U.S. PATENT DOCUMENTS

| | | | | |
|---|---|---|---|---|
| 5,052,920 | A | 10/1991 | Warren et al. | |
| 5,355,841 | A | 10/1994 | Moore, Jr. et al. | |
| 5,435,716 | A | 7/1995 | Joyce | |
| 5,676,539 | A | 10/1997 | Draper | |
| 5,875,739 | A | 3/1999 | Joyce | |
| 5,937,796 | A | 8/1999 | Sebastiani | |
| 6,019,069 | A | 2/2000 | Joyce | |
| 6,109,216 | A * | 8/2000 | Reynolds et al. | 122/13.01 |
| 6,230,665 | B1 * | 5/2001 | Reynolds et al. | 122/13.01 |
| 6,295,952 | B1 * | 10/2001 | Reynolds et al. | 122/14.31 |
| 6,435,140 | B1 | 8/2002 | Joyce | |
| 6,446,581 | B1 | 9/2002 | Carbone et al. | |
| 6,508,207 | B2 | 1/2003 | Shellenberger et al. | |
| 6,776,125 | B2 * | 8/2004 | Stretch et al. | 122/14.1 |
| 6,957,628 | B2 * | 10/2005 | Stretch et al. | 122/14.2 |
| 7,013,841 | B1 * | 3/2006 | Boros et al. | 122/19.2 |
| 7,032,543 | B1 * | 4/2006 | Akkala et al. | 122/14.31 |
| 7,040,258 | B2 | 5/2006 | Peart et al. | |
| 2003/0196609 | A1 * | 10/2003 | Stretch et al. | 122/17.1 |

OTHER PUBLICATIONS

Canadian Office Action, Office Action of Jan. 26, 2011, Application No. 2,656,723, 5 pages.

* cited by examiner

*Primary Examiner* — Gregory A Wilson
(74) *Attorney, Agent, or Firm* — Haynes and Boone, LLP

(57) ABSTRACT

A fuel-fired water heater is provided with a combustion chamber assembly, representatively a sealed combustion chamber assembly, operative to create from combustion air delivered thereto via a circumferentially limited vertical side portion thereof a flow of primary combustion air to the underside of a centrally disposed fuel burner within the assembly via a first location underlying the burner, a first flow of secondary combustion air delivered to the burner via the first location, and a second flow of secondary combustion air delivered to the burner via a second location outwardly circumscribing the first location.

19 Claims, 4 Drawing Sheets

WATER HEATER SEALED COMBUSTION CHAMBER ASSEMBLY

BACKGROUND OF THE INVENTION

The present invention generally relates to fuel-fired heating appliances and, in a representatively illustrated embodiment thereof, more particularly relates to a fuel-fired direct vent water heater having a specially designed sealed combustion chamber assembly incorporated therein.

Modern fuel-fired direct vent water heaters are commonly provided with a "sealed" combustion chamber. In this context, the term "sealed" means that the water heater combustion chamber does not exceed the internal pressure-created leakage test flow rates set forth in section 2.33.3 of the American National Standard/CSA Standard for Storage Water Heaters With Input Ratings of 75,000 Btu Per Hour or Less.

While this sealed combustion chamber design provides the direct vent water heater with a variety of operational advantages, including facilitating a flammable vapor ignition resistant design of the water heater, it also tends to introduce a variety of undesirable operational characteristics including diminished ignition performance leading to sooting in the combustion chamber, decreases in burner flame stability, increased NOx emissions and a lessening in combustion performance. It would thus be desirable to provide a combustion chamber assembly for a fuel-fired heating appliance, such as a water heater, in which these potential design problems are eliminated or at least substantially diminished.

SUMMARY OF THE INVENTION

In carrying out principles of the present invention, in accordance with an illustrated embodiment thereof, a fuel-fired heating appliance is provided with a specially designed combustion chamber assembly. Representatively, but not by way of limitation, the appliance is a direct vent water heater, and the combustion chamber assembly incorporated therein is of a sealed configuration.

The combustion chamber assembly, which forms a bottom portion of the water heater disposed beneath the storage tank portion of the water heater through which a flue upwardly extends, comprises a hollow body having an interior circumscribed by a side wall, a plate member extending generally transversely to the side wall and dividing the interior into a combustion chamber, from which a flue upwardly extends through the tank, and an air intake plenum disposed beneath the combustion chamber. A fuel burner is centrally disposed in the combustion chamber in a spaced relationship with the plate member, and in a facing relationship with a central portion thereof. An air transfer opening extends through the central portion of the plate member.

According to one aspect of the invention, a first wall structure is disposed in the air intake plenum and extends inwardly from the combustion air intake opening. The first wall structure forms a first passage for receiving air drawn inwardly through the combustion air intake opening and flowing a portion of the received air to the air transfer opening for transfer therethrough into the combustion chamber, the first passage having a volume substantially less that that of the air intake plenum. Illustratively, the first passage has a progressively narrowing configuration operative to funnel the portion of the received air to the air transfer opening, and the first wall structure includes two elongated, opposite sloped support leg structures underlying the plate member. Additional combustion air entering the air intake plenum may bypass the air transfer opening and flow into the combustion chamber via openings in the support legs and a peripheral gap circumscribing an outer edge portion of the plate member and disposed between such outer edge portion and a facing portion of the interior surface of the hollow body.

According to another aspect of the invention, a second wall structure is disposed in the combustion chamber and extends from the central portion of the plate member to adjacent the fuel burner, the second wall structure forming a second passage for receiving combustion air exiting the air transfer opening and flowing the received combustion air to the fuel burner. Illustratively, the second passage has a progressively narrowing configuration and is operative to funnel the received combustion air to the fuel burner. Preferably, the second wall structure includes an air transfer member having a hollow, generally frustroconical configuration with an open inlet end portion positioned against the plate member and circumscribing the air transfer opening therein, and a smaller area open outlet end portion positioned adjacent the fuel burner and separated therefrom by a gap through which combustion air may outwardly pass.

Illustratively, the fuel burner has a fuel/air mixture-receiving inlet structure generally aligned with the open outlet end portion of the air transfer member, and the water heater further comprises a fuel discharge nozzle disposed in the inlet end portion of the air transfer member and being operative to discharge received fuel for mixture with combustion air entering the air transfer member via the air transfer opening in the plate member.

DETAILED DESCRIPTION

Figure 1:
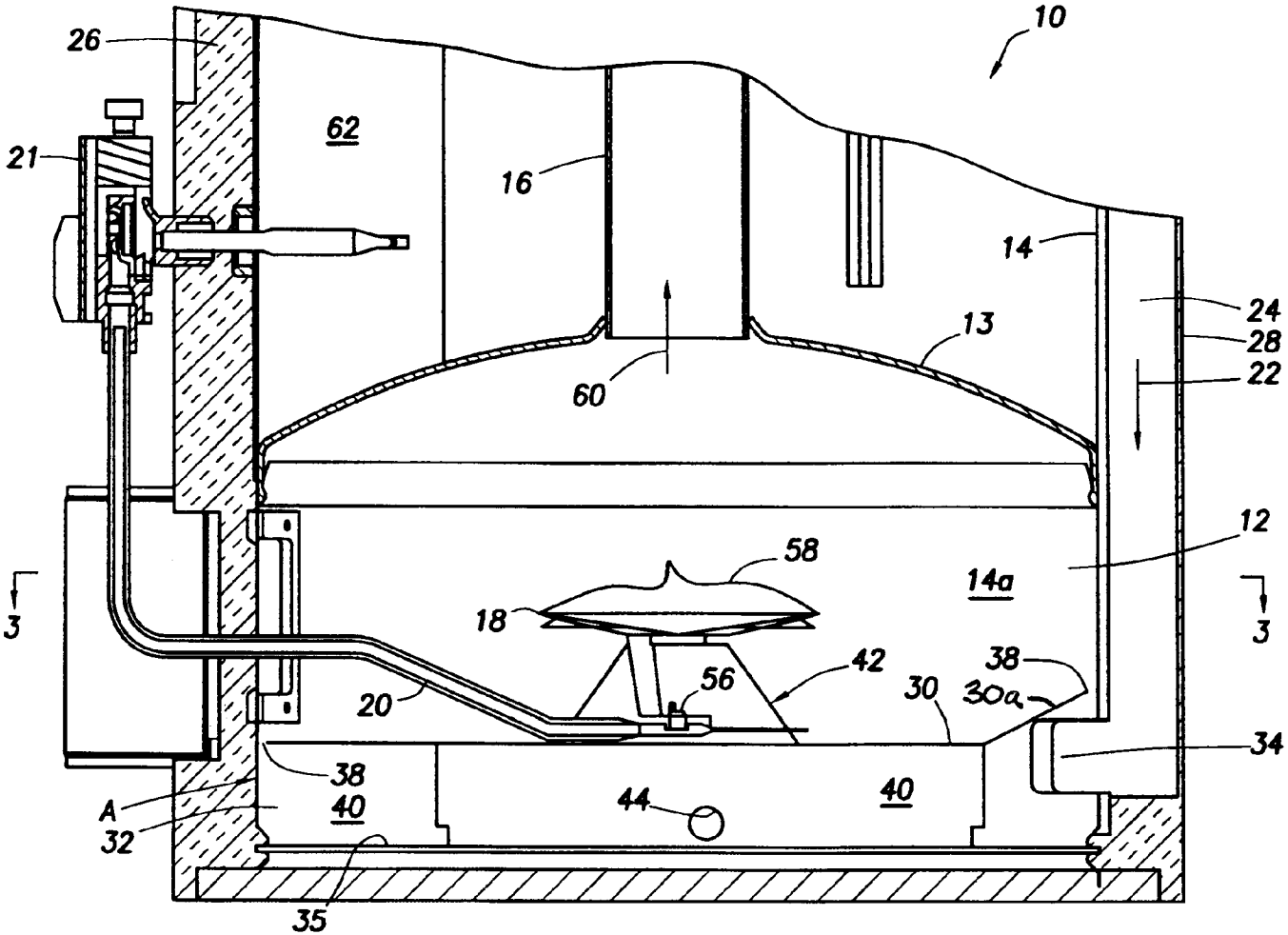
FIG. 1 is a simplified, somewhat schematic cross-sectional view taken through a bottom end portion of a representative fuel-fired direct vent water heater incorporating therein a specially designed sealed combustion chamber assembly embodying principles of the present invention.
Figure 2:
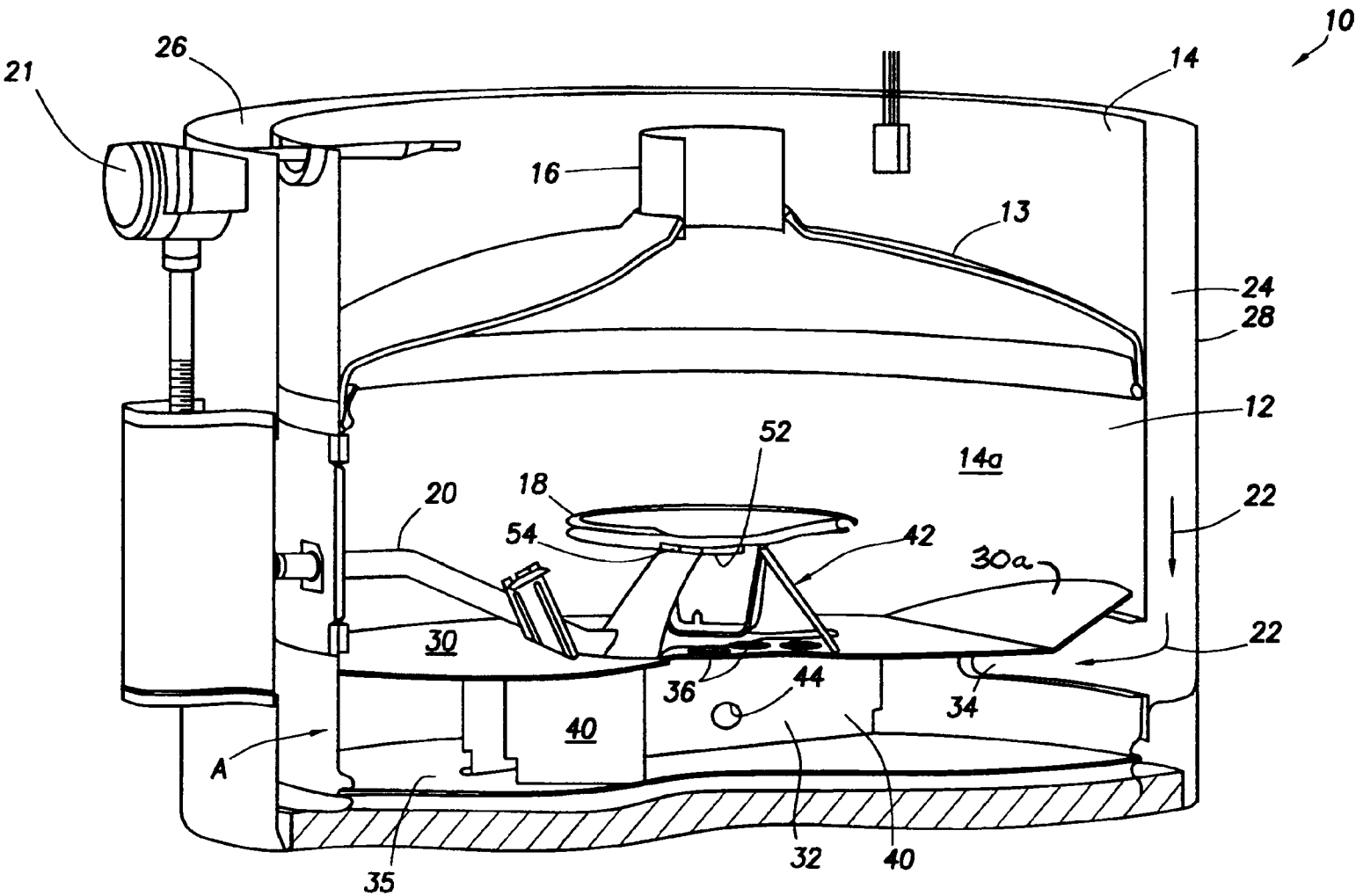
FIG. 2 is a schematic perspective view of the water heater portion cross-sectionally illustrated in FIG. 1.

This invention provides a fuel-fired heating appliance which is representatively a direct vent water heater 10, a lower portion of which is somewhat schematically depicted in FIGS. 1 and 2. While principles of the present invention are representatively incorporated in a water heater, it will be readily appreciated by those of ordinary skill in this particular art that fuel-fired heating appliances of other types (such as, for example, boilers or fuel-fired furnaces) may be alternatively utilized without departing from principles of the present invention.

Water heater 10 is illustratively a gas-fired direct vent water heater and has a combustion chamber 12 underlying the bottom wall 13 a vertically oriented, generally circularly cross-sectioned water storage tank 14 through the interior of which a flue 16, communicating with the combustion chamber 12, upwardly extends. A gas burner 18 is disposed within the combustion chamber 12 and is supplied with fuel through a gas supply line 20 connected to the usual thermostatic gas valve 21 mounted on a side portion of the tank 14. Combustion air 22 is also supplied to the burner 18, in a unique manner subsequently described herein, via an air delivery passage 24 extending downwardly through an insulation space 26 disposed between the tank 14 and a metal jacket structure 28 outwardly surrounding the tank 14 in a manner similar to that shown in FIG. 3 of U.S. Pat. No. 7,013,841 (which is hereby incorporated herein by reference) assigned to the same assignee as the present application. Air passage 24, which communicates at its inlet end with a source of air external to the location of the water heater 10 (illustratively outside air), is illustratively the sole path through which combustion air can enter the combustion chamber 12.

Figure 3:
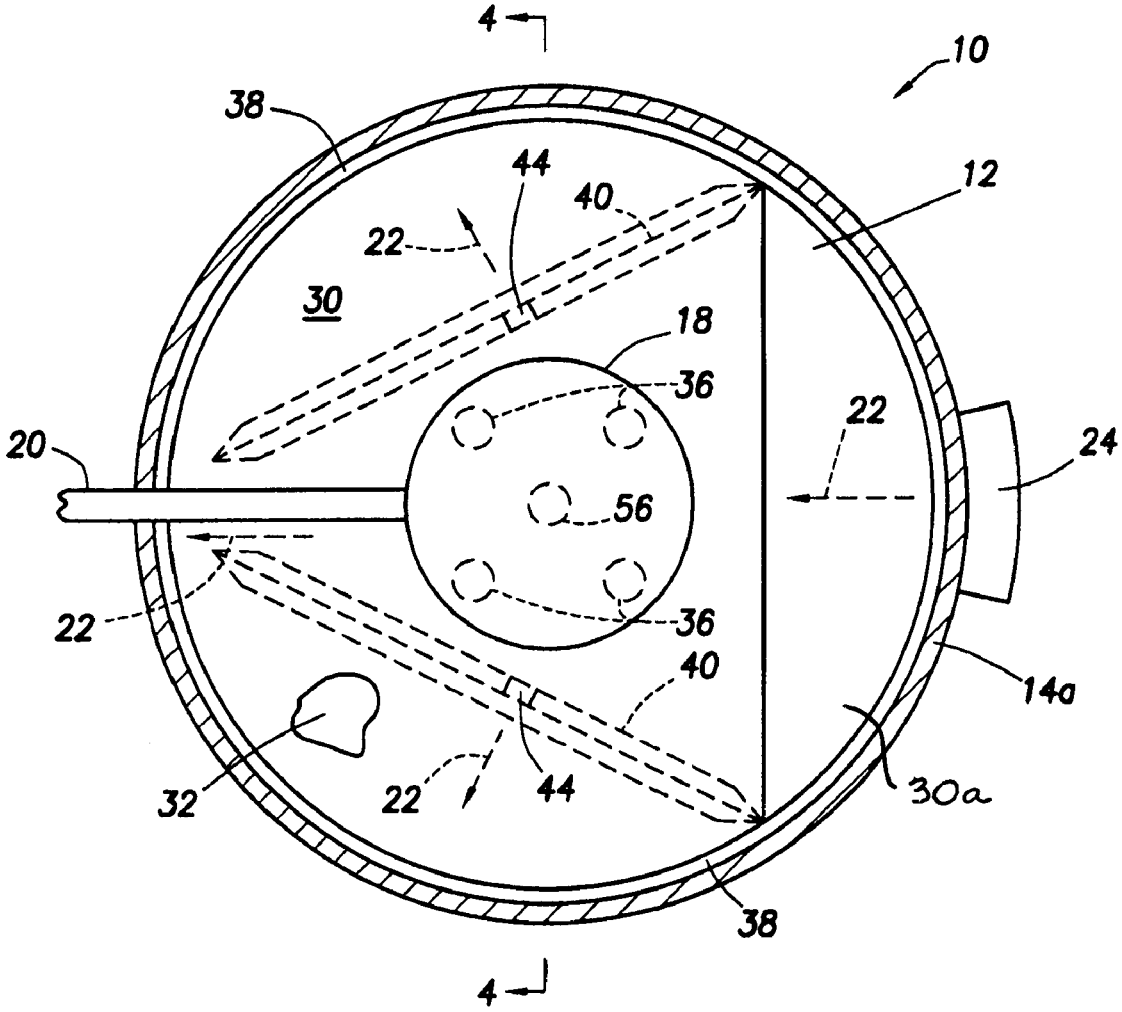
FIG. 3 is a reduced scale schematic cross-sectional view through the FIG. 1 water heater portion taken generally along line 3-3 of FIG. 1.

Combustion chamber 12 forms a portion of a specially designed sealed combustion chamber assembly A that houses the burner 18 and embodies principles of the present invention. Combustion chamber 12 is bounded on its top side by the bottom wall 13 of the tank 14, and on its side by a downward side wall extension 14*a* of the tank 14. The bottom wall of the combustion chamber 12 is defined by a circular air transfer plate structure 30 which also forms the top wall of an air inlet plenum 32 that underlies the combustion chamber 12 and communicates with the air passage 24 via a side wall opening 34 of the plenum 32. Air inlet plenum 32 has a bottom wall 35. Air transfer openings 36 (see FIGS. 2-4) are formed in a central portion of the air transfer plate 30. For purposes later described herein, there is a circular gap 38 between the periphery of the air transfer plate 30 and the inner side surface of the combustion chamber side wall 14*a*. As best illustrated in FIGS. 1-3, a peripheral portion 30*a* of the air transfer plate 30 at the side wall opening 34 of the plenum 32 is upwardly bent to clear the side wall opening 34.

With reference now to FIGS. 1-4, sealed combustion chamber assembly A also includes a pair of elongated, generally strip-shaped support legs 40 underlying the air transfer plate 30 within the plenum 32, and a generally frustroconically-shaped hollow air transfer member 42 disposed atop the air transfer plate 30 and overlying the air transfer openings 36 therein.

As illustrated in FIGS. 1-4, the widths of the support legs 40 extend between the bottom side of the air transfer plate 30 and the bottom wall 35 of the plenum 32 and have generally circular air outlet openings 44 therein. As viewed from the top (see FIG. 3), legs 40 slope leftwardly and inwardly toward one another, with the right ends of the legs 40 being disposed closely adjacent the side wall section 14*a*, on opposite sides of the air passage 24, and being spaced further apart from one another than the left ends of the legs 40 which are spaced inwardly apart from the side wall section 14*a*. As also can be best seen in FIG. 3, the air transfer openings 36 in the air transfer plate 30 are disposed above the lateral space between the oppositely sloped support legs 40.

Figure 4:
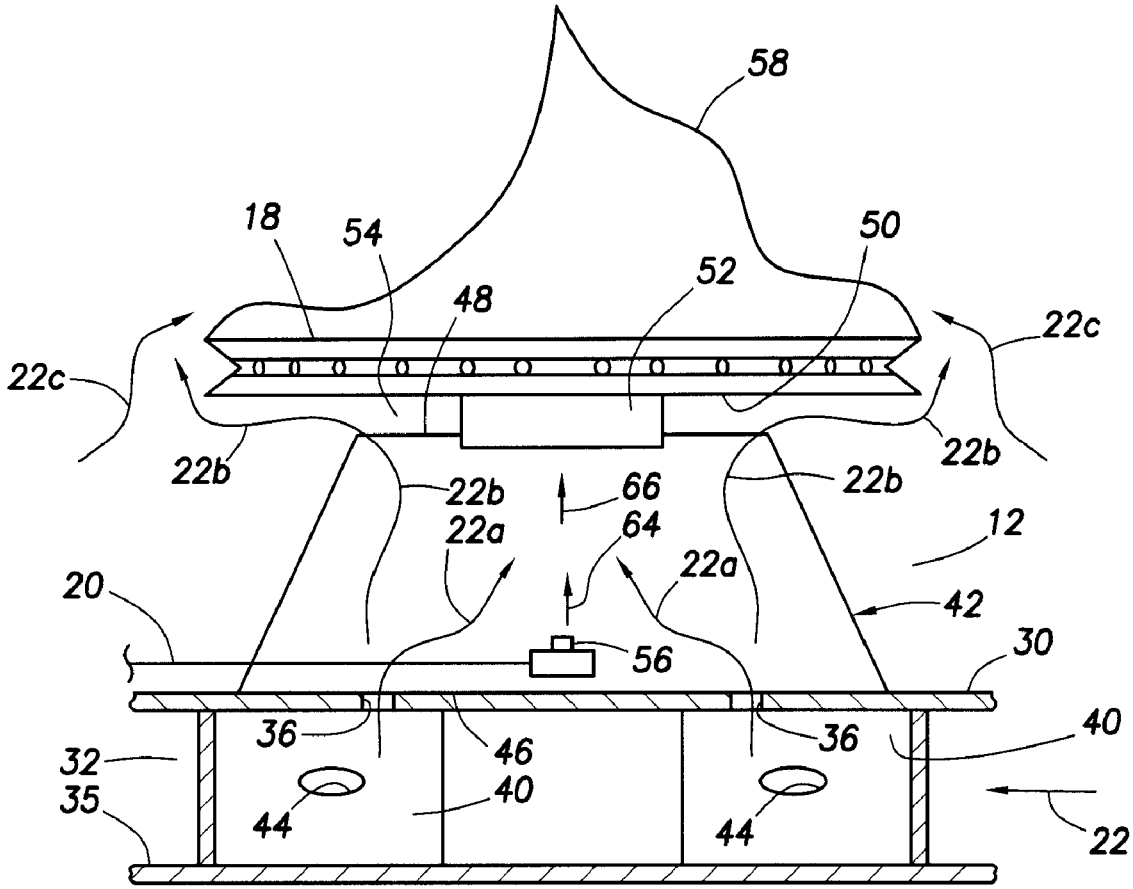
FIG. 4 is an enlarged scale schematic cross-sectional view through the FIG. 3 water heater portion taken generally along line 4-4 of FIG. 3.

As may be best seen in FIG. 4, the frustroconically shaped hollow air transfer member 42 has an open circular bottom end 46 that rests atop the air transfer plate 30 and circumscribes the plurality of air transfer openings 36 formed therein, and an open, smaller diameter circular top end 48 that is centrally positioned beneath the bottom side 50 of the burner 18 and circumscribes a fuel/air mixture inlet structure 52 extending downwardly therefrom. An annular gap 54 is formed between the top end 48 of the air transfer member 42 and the bottom side 50 of the burner 18. The previously mentioned gas supply line 20 extends into the interior of the frustroconical air transfer member 42, through a bottom end portion thereof, and is connected to a fuel discharge nozzle 56 disposed in the interior of the air transfer member 42 beneath the fuel/air mixture inlet structure 52.

With reference now to FIGS. 1, 3 and 4, during firing of the water heater 10, a flame 58 is created by the burner 18 within the combustion chamber 12. The resulting hot combustion gases 60 (see FIG. 1) are drawn upwardly through the flue 16, with combustion heat from such gases 60 being transferred through the flue 16 to water 62 stored within the tank 14 for on-demand delivery therefrom in a conventional manner to various hot water-utilizing plumbing fixtures operatively communicated with the tank interior.

At the same time, combustion air 22 is drawn downwardly through the passage 24 and into the air transfer plenum 32 through its side wall opening 34. Combustion air 22 drawn into the air transfer plenum 32 in this manner travels leftwardly therethrough (as viewed in FIG. 3) and is funneled horizontally inwardly towards the openings 36 in the air transfer plate 30 by the oppositely sloped support legs 40 that underlie the plate 30.

A first portion of the combustion air 22 entering the air transfer plenum 32 passes upwardly through the plate openings 36 (see FIG. 4) into the interior of the frustroconical air transfer member 42 and forms primary combustion air 22*a* that mixes with fuel 64 being discharged from the nozzle 56 to form therewith a fuel/air mixture 66 delivered to the burner fuel/air mixture inlet structure 52.

A second portion of the combustion air 22 entering the air transfer plenum 32 passes upwardly through the plate openings 36 (see FIG. 4) into the interior of the frustroconical air transfer member 42 and forms secondary combustion air 22*b* (i.e., excess combustion air that is not mixed with the discharged fuel 64) which passes outwardly through the annular gap 54 and is fed to the flame 58 around the periphery of the burner 18.

A third portion of the combustion air 22 entering the air transfer plenum 32 bypasses the transfer plate openings 36 and flows upwardly into the combustion chamber 12 via the gap 38 (see FIG. 3) between the periphery of the air transfer plate 30 and the side wall portion 14*a*. A first quantity of this third portion flow upwardly through the gap 38 before entering the funneled space between the support legs 40, a second quantity flows outwardly through the support leg openings 44 and then upwardly through the gap 38, and the remainder of the third portion exits through the left end space between the legs 40 and then flows upwardly through the gap 38 into the combustion chamber 12. As schematically depicted in FIG. 4, this combustion air entering the combustion chamber 12 upwardly through the gap 38 flow from all around the gap to the periphery of the burner 18 as additional secondary combustion air 22*c*.

As can be readily seen from the foregoing, despite the introduction of combustion air 22 to the plenum 32 via only a limited circumferential side wall portion thereof, the sealed combustion chamber assembly A of the present invention functions to provide accurate positional control of the delivered combustion air by routing primary combustion air 22*a* to a location directly beneath the centrally located burner 18, for mixture with the discharged fuel 64), and by routing secondary air flows 22*b*,22*c* uniformly to the periphery of the burner 18 for supporting the flame 58 which it creates. Because of this positional control of incoming combustion air, the sealed combustion chamber assembly A provides the water heater 10 with enhanced ignition performance, decreased NOx emissions, and increased combustion performance.

As previously mentioned herein, the present invention is not limited to water heaters, but may also be utilized to advantage in a variety of other types of fuel-fired heating appliances such as, for example but not by way of limitation, boilers and furnaces. A variety of modifications may be made to the representatively disclosed heating appliance structure without departing from principles of the present invention. For example, the combustion air may be delivered to the water heater through a path external to the outer jacket portion of the water heater. Additionally, while the representatively depicted water is a direct vent water heater, it could be an alternative type of water heater.

The foregoing detailed description is to be clearly understood as being given by way of illustration and example only, the spirit and scope of the present invention being limited solely by the appended claims.

What is claimed is:

1. A fuel-fired heating appliance having a combustion chamber assembly comprising:

a hollow body having an interior circumscribed by a side wall;

a plate member extending generally transversely to said side wall and dividing said interior into a combustion chamber and an air intake plenum;

a combustion air intake opening extending through said side wall into said air intake plenum;

a fuel burner centrally disposed in said combustion chamber in a spaced relationship with said plate member and in a facing relationship with a central portion thereof;

an air transfer opening extending through said central portion of said plate member; and a wall structure disposed in said air intake plenum and extending inwardly from said combustion air intake opening, said wall structure forming a passage for receiving air drawn inwardly through said combustion air intake opening and flowing a portion of the received air to said air transfer opening for transfer therethrough into said combustion chamber, said passage having a volume substantially less than that of said air intake plenum, said wall structure including two elongated, oppositely sloped support leg structures underlying said plate member, and said passage extending between said leg structures, having a progressively narrowing configuration, and being operative to horizontally funnel said portion of the received air to said air transfer opening.

2. The fuel-fired heating appliance of claim 1 wherein:

said fuel-fired heating appliance is a water heater having a bottom portion including said combustion chamber assembly.

3. The fuel-fired heating appliance of claim 2 wherein:

said water heater has a tank circumscribed by a jacket structure which defines with said tank an insulation space, and a combustion air passage extending downwardly through said insulation space and communicating with said combustion air intake opening.

4. The fuel-fired heating appliance of claim 2 wherein:

said combustion chamber assembly is a sealed combustion chamber assembly.

5. The fuel-fired heating appliance of claim 2 wherein:

said water heater is a direct vent water heater.

6. A fuel-fired heating appliance having a combustion chamber assembly comprising:

a hollow body having an interior circumscribed by a side wall;

a plate member extending generally transversely to said side wall and dividing said interior into a combustion chamber and an air intake plenum;

a combustion air intake opening extending through said side wall into said air intake plenum;

a fuel burner centrally disposed in said combustion chamber in a spaced relationship with said plate member and in a facing relationship with a central portion thereof;

an air transfer opening extending through said central portion of said plate member; and a wall structure disposed in said air intake plenum and extending inwardly from said combustion air intake opening, said wall structure forming a passage for receiving air drawn inwardly through said combustion air intake opening and flowing a portion of the received air to said air transfer opening for transfer therethrough into said combustion chamber, said passage having a volume substantially less than that of said air intake plenum, said passage being a first passage, and said combustion chamber assembly further comprising a second passage through which a second portion of the air drawn inwardly through said combustion air intake opening into said air intake plenum may flow into said combustion chamber without flowing through said air transfer opening, said second passage including holes formed through said support leg structures.

7. A fuel-fired heating appliance having a combustion chamber assembly comprising:

a hollow body having an interior circumscribed by a side wall;

a plate member extending generally transversely to said side wall and dividing said interior into a combustion chamber and an air intake plenum;

a combustion air intake opening extending through said side wall into said air intake plenum;

a fuel burner centrally disposed in said combustion chamber in a spaced relationship with said plate member and in a facing relationship with a central portion thereof;

an air transfer opening extending through said central portion of said plate member; and a wall structure disposed in said air intake plenum and extending inwardly from said combustion air intake opening, said wall structure forming a passage for receiving air drawn inwardly through said combustion air intake opening and flowing a portion of the received air to said air transfer opening for transfer therethrough into said combustion chamber, said passage having a volume substantially less than that of said air intake plenum, said passage being a first passage, and said combustion chamber assembly further comprising a second passage through which a second portion of the air drawn inwardly through said combustion air intake opening into said air intake plenum may flow into said combustion chamber without flowing through said air transfer opening, said second passage including a circumferential gap between said plate member and said side wall of said hollow body.

8. A fuel-fired heating appliance having a combustion chamber assembly comprising:

a hollow body having an interior circumscribed by a side wall;

a plate member extending generally transversely to said side wall and dividing said interior into a combustion chamber and an air intake plenum, said plate member having an air transfer opening extending through a central portion thereof;

a combustion air intake opening, extending through said side wall into said air intake plenum, through which combustion air may be drawn into said air intake plenum for delivery of a portion of the incoming combustion air to said combustion chamber via said air transfer opening;

a fuel burner centrally disposed in said combustion chamber in a spaced relationship with said plate member and in a facing relationship with said central portion thereof; and a wall structure disposed in said combustion chamber and interposed between said central portion and said fuel burner, said wall structure defining in said combustion chamber an upwardly and horizontally inwardly sloping passage for receiving said combustion air portion exiting said air transfer opening and funneling the received combustion air portion upwardly to said fuel burner.

9. The fuel-fired heating appliance of claim 8 wherein:

said wall structure includes an air transfer member having a hollow, generally frustroconical configuration.

10. The fuel-fired heating appliance of claim 8 wherein said combustion chamber assembly further comprises:

a peripheral gap, disposed between the periphery of said plate member and the interior of said side wall of said hollow body, for transferring combustion air from said air intake plenum into said combustion chamber.

11. The fuel-fired heating appliance of claim 8 wherein:

said fuel-fired heating appliance is a water heater having a bottom portion including said combustion chamber assembly.

12. The fuel-fired heating appliance of claim 11 wherein:

said water heater has a tank circumscribed by a jacket structure which defines with said tank an insulation space, and a combustion air passage extending downwardly through said insulation space and communicating with said combustion air intake opening.

13. The fuel-fired heating appliance of claim 11 wherein:

said combustion chamber assembly is a sealed combustion chamber assembly.

14. The fuel-fired heating appliance of claim 11 wherein:

said water heater is a direct vent water heater.

15. A fuel-fired heating appliance having a combustion chamber assembly comprising:

a hollow body having an interior circumscribed by a side wall;

a plate member extending generally transversely to said side wall and dividing said interior into a combustion chamber and an air intake plenum, said plate member having an air transfer opening extending through a central portion thereof;

a combustion air intake opening, extending through said side wall into said air intake plenum, through which combustion air may be drawn into said air intake plenum for delivery of a portion of the incoming combustion air to said combustion chamber via said air transfer opening;

a fuel burner centrally disposed in said combustion chamber in a spaced relationship with said plate member and in a facing relationship with said central portion thereof; and a wall structure disposed in said combustion chamber and extending from said central portion to adjacent said fuel burner, said wall structure forming a passage for receiving said combustion air portion exiting said air transfer opening and flowing the received combustion air portion to said fuel burner, said passage having a progressively narrowing configuration and being operative to funnel said combustion air portion to said fuel burner, said wall structure including an air transfer member having a hollow, generally frustroconical configuration, and said air transfer member having an open inlet end portion positioned against said plate member and circumscribing said air transfer opening therein, and a smaller area open outlet end portion positioned adjacent said fuel burner and separated therefrom by a gap.

16. The fuel-fired heating appliance of claim 15 wherein:

said fuel burner has a fuel/air mixture-receiving inlet structure generally aligned with said open outlet end portion of said air transfer member, and said fuel-fired heating appliance further comprises a fuel discharge nozzle disposed in said inlet end portion of said air transfer member and operative to discharge received fuel for mixture with combustion air entering said air transfer member via said air transfer opening.

17. A fuel-fired, direct vent water heater comprising:

a tank for holding pressurized heated water;

a combustion chamber disposed beneath said tank a flue extending upwardly from said combustion chamber through said tank;

a fuel burner centrally disposed within said combustion chamber and having a fuel/air mixture-receiving inlet structure;

an air intake plenum disposed beneath said combustion chamber and having a combustion air intake opening for receiving combustion air from a source thereof;

a plate member generally forming a bottom wall of said combustion chamber and a top wall of said air intake plenum, said plate member having a central portion with an air transfer opening extending therethrough, said central portion being in a spaced apart, opposing relationship with said fuel/air mixture-receiving inlet structure;

a first wall structure defining a first passage extending through said air intake plenum from said combustion air intake opening, said first passage having a progressively narrowing configuration and being operative to funnel combustion air to said air transfer opening from said combustion air intake opening;

a second wall structure defining a second passage extending from said air transfer opening to adjacent said fuel/air mixture-receiving inlet structure, said second passage having a progressively narrowing configuration and being operative to funnel combustion air to said fuel/air mixture-receiving structure from said air transfer opening; and a nozzle structure disposed in said second passage and being operative to discharge fuel received from a source thereof.

18. The water heater of claim 17 further comprising:

a circumferential combustion air transfer gap disposed between an outer edge portion of said plate member and an adjacent wall portion of said combustion chamber and forming a combustion air transfer passage through which combustion air within said air intake plenum may flow upwardly into said combustion chamber.

19. The water heater of claim 17 further comprising:

a jacket structure outwardly circumscribing said tank and defining therewith a vertically extending insulation space, and a combustion air passage extending downwardly through said insulation space and communicating with said combustion air intake opening.

* * * * *